US005803300A

United States Patent [19]

DeMars

[11] Patent Number: 5,803,300

[45] Date of Patent: Sep. 8, 1998

[54] TRASH CONTAINER WITH BAG HOLDER

[76] Inventor: Robert A. DeMars, 5000 N. Parkway Calabasas, Suite 233, Calabasas, Calif. 91302

[21] Appl. No.: 762,765

[22] Filed: Dec. 10, 1996

[51] Int. Cl.[6] ..... B65D 43/00

[52] U.S. Cl. ..... 220/404; 220/908

[58] Field of Search ..... 220/407, 409, 220/404, 908

[56] References Cited

U.S. PATENT DOCUMENTS

| | | | |
|---|---|---|---|
| 4,444,355 | 4/1984 | Cary | 220/404 |
| 4,630,752 | 12/1986 | DeMars | 220/404 |
| 4,715,572 | 12/1987 | Robbins, III et al. | 220/404 |
| 4,753,367 | 6/1988 | Miller et al. | 220/404 |
| 4,765,579 | 8/1988 | Robbins, III et al. | 220/404 |
| 4,917,263 | 4/1990 | Korb | 220/404 |
| 4,953,740 | 9/1990 | Koda | 220/404 |

*Primary Examiner*—Joseph M. Moy
*Attorney, Agent, or Firm*—Jack C. Munro

[57] ABSTRACT

A trash container which is formed of a trash can body terminating at its upper end in a rim which surrounds an access opening into the internal chamber of the trash can body. A flexible walled replaceable bag is to be inserted within the internal chamber with the mouth of the bag being draped over the rim. The bag is to be held in place by means of a mounting ring which comprises bag holding means which is to be placed over the rim binding the bag between the ring and the trash can body holding the bag completely open while in the trash can body. The ring is to be pivotally mounted to the trash can body to be pivoted to a displaced position permitting changing of the bag.

6 Claims, 2 Drawing Sheets

TRASH CONTAINER WITH BAG HOLDER

BACKGROUND OF THE INVENTION

1. Field of the Invention

The field of this invention relates to trash containers and more particularly to a trash container with a bag holding mechanism which firmly supports a flexible walled plastic bag in an open configuration within the container.

2. Description of the Prior Art

Both separate trash containers and trash bags have long been known and used. A common form of a trash container comprises a rigid body which forms an internal chamber with there being an access opening provided within a rim at the upper end of the internal chamber. A lid is connectable with the rim to close the access opening. When the lid is removed, trash is able to be thrown into, collected and remain within the trash can body. A common form of a trash bag comprises a bag generally of plastic which is so flexible it cannot be easily held open to facilitate the placing of trash into the bag.

Frequently, trash is not clean. The trash could contain dirt, oil and even food particles which could be capable of contaminating the inside wall of the trash can body if such were permitted to come into contact with the trash can body. For this reason, it is desirable to line the wall of the internal chamber of the trash can body with some kind of a replaceable bag. Normally, a plastic bag is most preferred. It has been common to drape the mouth of the plastic bag over the rim of the trash can body and then trash is to be inserted within the bag in the trash container in the normal manner.

There is normally not used any type of holding means to hold the trash bag into a trash can. Therefore, as soon as trash is dumped into the bag, the mouth of the bag, that is draped over the rim of the trash can, frequently becomes dislodged from the rim and falls into the internal chamber of the trash can making it difficult to add more trash to the bag. Therefore, in order to place the bag in position ready to receive additional trash, it has been necessary for the operator to grab the mouth of the trash bag and redrape it over the rim of the trash can. This procedure gets to be rather annoying and inefficient as every time something is deposited into the trash bag, redraping of the bag is required. When a trash bag is used separately, it is not held open by any means. Therefore, the user must try to hold the bag open with one hand while trying to place the trash in the bag with the other hand.

It would be desirable to design a trash can that included a device that automatically fixed in position the mouth of a replaceable bag which is contained within a trash can.

SUMMARY OF THE INVENTION

The subject matter of the present invention comprises a trash container in the form of a trash can body which has an internal chamber and which terminates at a rim which surrounds an access opening providing access into the internal chamber. A ring is pivotally mounted about a hinge to the trash can body directly adjacent the rim. This ring is capable of being pivoted from a position spaced from the access opening to a position in engagement with the rim surrounding the access opening. Mounted within the ring is a series of binding devices in the form of blocks of material constructed of a deflectable material. Four in number of the blocks are recommended to be used. These blocks are deflected slightly when the ring is inserted into position over the rim. The mouth of the flexible walled plastic bag is to be draped over the rim, at least at the location of the blocks, prior to mounting of the ring on the rim thereby binding the mouth of the bag between the ring and the trash can body. The trash can body normally would include a wheel assembly to facilitate low frictional movement of the trash can body on a supporting surface. A handle is mounted on the trash can body which is to be used to facilitate movement of the trash container. The handle is mounted diametrically opposite the hinge connection of the ring to the trash can body.

The primary objective of the present invention is to construct a trash container that holds in open position a flexible walled plastic bag that is mounted within a trash can and keeps the plastic bag from falling within the trash can as trash is inserted within the bag until it is full.

Another objective of the present invention is to construct a trash can which is more efficient for the user and can be sold at a reasonable cost to the consumer.

DETAILED DESCRIPTION OF THE PREFERRED EMBODIMENT

Figure 1:
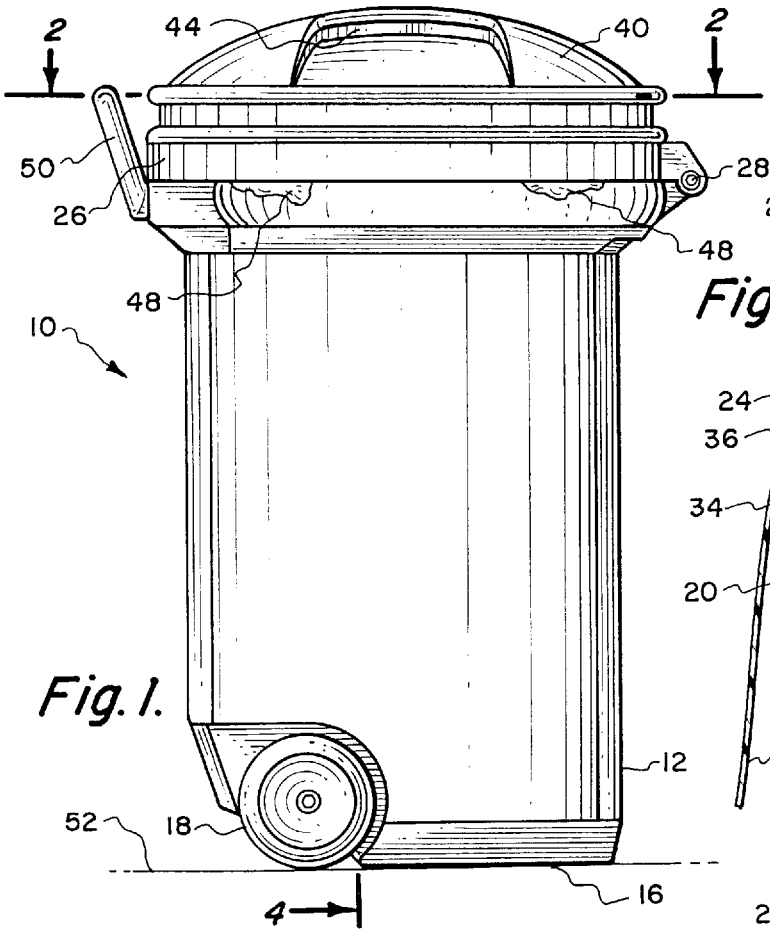
FIG. 1 is a side elevational view of the trash container of the present invention showing the trash container in the position of supporting a flexible walled plastic bag within the trash can body.
Figure 2:
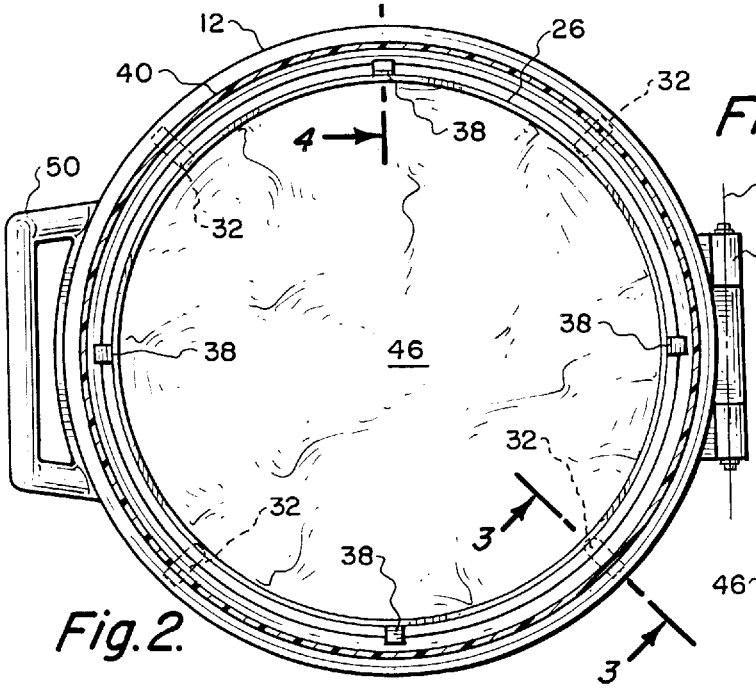
FIG. 2 is a cross-sectional view through the rim of the trash container of the present invention taken along line 2—2 of FIG. 1.
Figure 3:
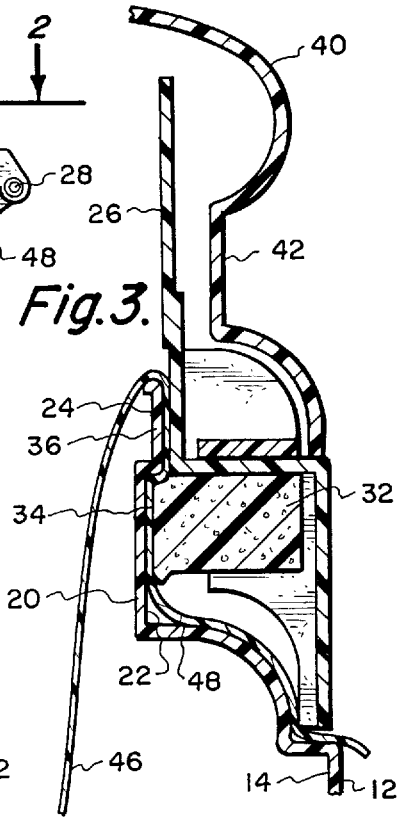
FIG. 3 is a transverse cross-sectional view through a portion of the rim of the trash container of the present invention taken along line 3—3 of FIG. 2.
Figure 4:
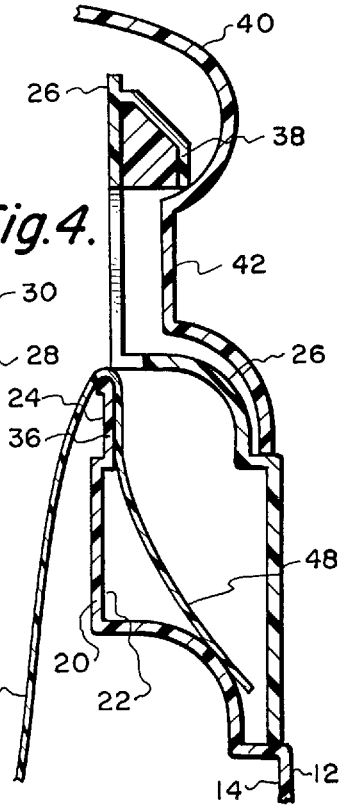
FIG. 4 is a transverse cross-sectional view through the rim of the trash container of the present invention taken along line 4—4 of FIG. 2.

Referring particularly to the drawings, there is shown the trash container 10 of this invention which includes a trash can body 12. The trash can body 12 includes an internal chamber 14. The trash can body 12 includes a bottom 16. Mounted directly adjacent the bottom 16 are a pair of wheels 18 with only one wheel being shown.

The trash can body 12 has at its upper end an annular rim 20. The rim 20 includes an annular recess 22. Rim 20 surrounds access opening 24 which provides access into the internal chamber 14.

Figure 5:
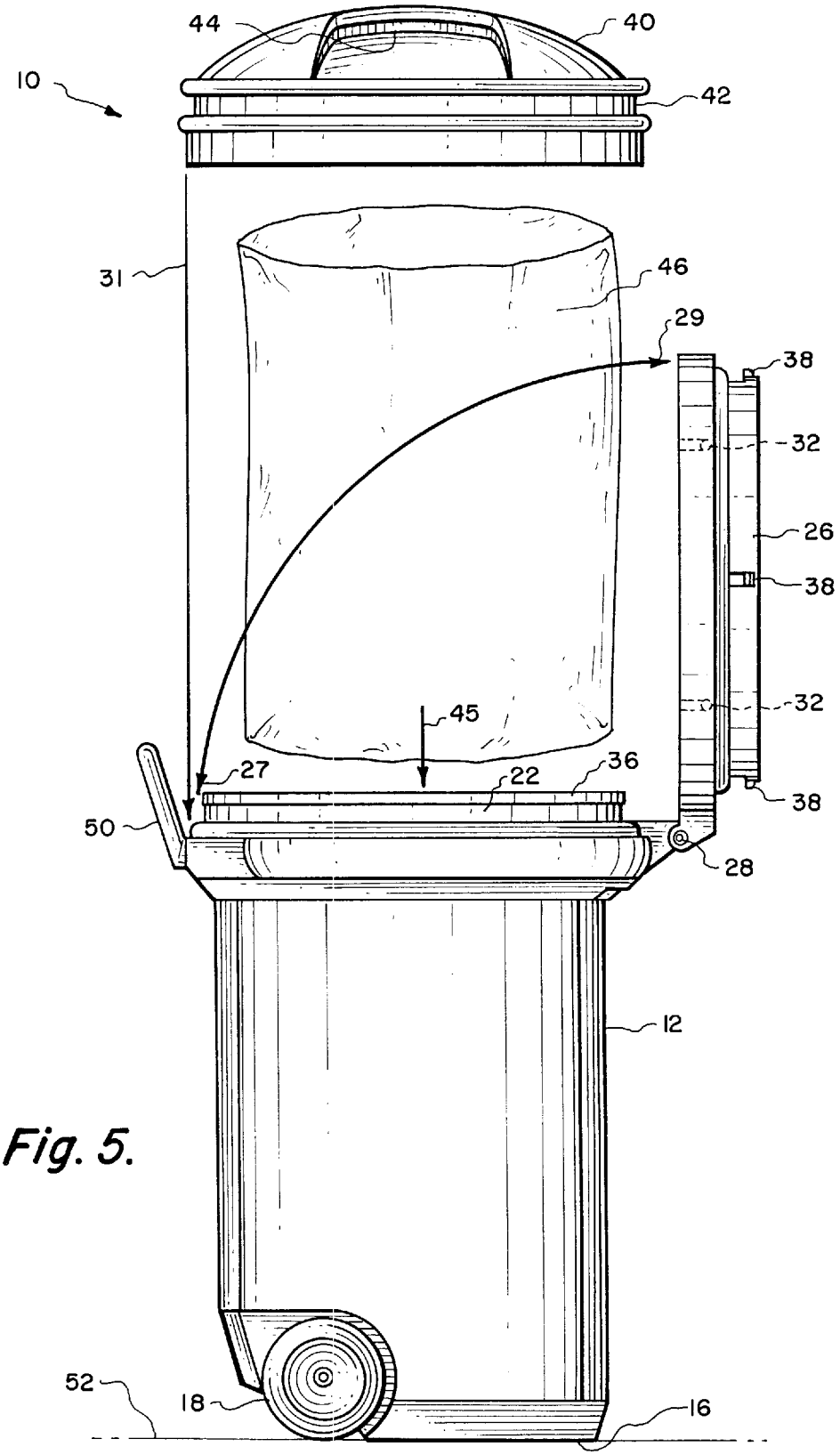
FIG. 5 is an exploded side elevational view of the trash container of the present invention showing the trash container in the position of installing of a flexible walled plastic bag within the trash can body.

A ring 26 is pivotally mounted to the trash can body 12 by means of hinge 28. The hinge 28 is mounted directly connected to the rim 20. Also, the hinge 28 is mounted on the trash can body 12 at the furthest position away from the wheels 18. It is to be noted that the hinge axis 30 is located parallel to the plane of the bottom 16 and tangential to the trash can body 12. The ring 26 is to be pivotable about the hinge 28 from a position spaced from the rim 20 (FIG. 5) in direction of arrow 27 to a position surrounding the rim 20 (FIG. 1).

Mounted on the interior surface of the ring 26 are a plurality of blocks 32. The blocks 32 are evenly spaced apart and, since there are four in number of the blocks 32, the blocks are ninety degrees apart. Even though the trash can 12 is shown to be cylindrical, it is to be understood that the trash can 12 could be a configuration other than cylindrical in which case a different block 32 positioning arrangement would be utilized. The blocks 32 are to be constructed of a rubber or a rubberized plastic material. It is to be understood that, as far as this invention is concerned, referring to the blocks 32 as rubber includes both rubber, rubberized plastic and possibly any other material that is slightly compressible or deflectable. The forward edge 34 of the blocks 32 is to be able to be positioned within the annular recess 22 of the rim 20. As the ring 26 is moved from a spaced position from rim 20 to a position engaging with the rim 20, the forward edge 34 of the blocks 32 will deflect as the blocks 32 move past annular protrusion 36 of the rim 20. When the blocks 32 connect with the annular recess 22, a slight snapping action is caused to occur which holds the blocks 32 in the position in conjunction with the recess 22. It is to be understood that the ring 26 is to be manually moved between the position spaced from the rim 20 and the position engaged with rim 20.

The ring 26 also includes a plurality of outwardly extending protrusions 38. It is to be the function of the protrusions 38 to provide a snap type of lock for the lid 40. The lid 40 has an inwardly deflected section 42, and as the lid 40 is installed in conjunction with the ring 26 in the direction of arrow 31, the section 42 is to be forcibly moved over the outwardly extending protrusions 38 until the section 42 is located beneath the outwardly extending protrusions 38 thereby forming a slight snap lock of the lid 40 relative to the ring 26. Manual removal of the lid 40 is accomplished by means of handle area 44.

A flexible walled plastic bag 46 is to be placed within the internal chamber 14 in direction of arrow 45 substantially closely conforming to the sidewall of the internal chamber 14. The mouth 48 of the flexible walled plastic bag 46 is to be draped over the rim 20 prior to installation of the ring 26 about the rim 20. With the mouth 48 of the flexible walled plastic bag 46 draped over the rim 20, the ring 26 is then pivoted until the blocks 32 pass by the annular protrusion 36 and connect with the annular recess 22. Each block 32 will bind a portion of the mouth 48 of the flexible walled plastic bag 46 against the wall surface of the annular recess 22. This binding force will sufficiently hold the flexible walled plastic bag 46 in position so that when trash is deposited within the flexible walled plastic bag 46 that the flexible walled plastic bag 46 will remain bound to the rim 20 and not be dislodged therefrom. Therefore, the flexible walled plastic bag 46 will always be held in the open position when contained within the trash container 10 of this invention. With the ring 26 in position capturing the flexible walled plastic bag 46, the lid 40 can now be installed in conjunction with the ring 26 as previously mentioned.

When the flexible walled plastic bag 46 has received the desired amount of trash, the lid 40 is removed and the ring 26 is pivoted in direction of arrow 29 about the hinge 28 disconnecting the blocks 32 from the annular recess 22. The mouth of the flexible walled plastic bag 46 can then be disconnected from the rim 20 and the entire flexible walled plastic bag 46, and its contents, be removed from the internal chamber 14. The flexible walled plastic bag 46 and its contents is then intended to be discarded.

It is desirable that the trash container 10 of this invention be movable on the wheels 18. To facilitate this movement, a handle 50 is mounted on the trash can body 12. The handle 50 is positioned on the same side of the trash can body 12 as the wheels 18 and diametrically opposite the hinge 28. Using the handle 50, the trash can body 12 of this invention can be tilted causing the bottom 16 to be spaced from the supporting surface 52. The trash can body 12 can then be moved on the supporting surface 52 by the wheels 18. The reason the hinge 28 is positioned diametrically opposite the handle 50 is so the handle 50 will not interfere with the installation and removal of the ring 26 from the rim 20.

What is claimed is:

1. A trash container with bag holder comprising:

a trash can body having an internal chamber, said trash can body having a fixed rim, said rim surrounds an access opening, said access opening connecting with said internal chamber and provides access into said internal chamber;

a ring separate from said trash can body, said ring being locatable about said rim in a close conforming manner, said rim being disengageable from said ring; and binding means mounted in conjunction with said ring, said binding means comprising a plurality of blocks located in a spaced apart arrangement, each said block being formed of deflectable material, said binding means for exerting a pressing force against said rim when said ring is mounted on said rim, whereby upon a flexible walled bag being inserted within said internal chamber and the mouth of the bag being draped over said rim said ring is to be placed on said rim with said blocks to cause securing in position of the bag by binding of the mouth area of the bag between said blocks and said rim.

2. The trash container with bag holder as defined in claim 1 wherein:

said trash can body being cylindrical.

3. The trash container with bag holder as defined in claim 2 wherein:

said ring being pivotally mounted by a hinge assembly on said trash can body, said hinge assembly having a pivot axis, said pivot axis being located tangential to said trash can body, said hinge assembly being mounted directly adjacent said rim.

4. The trash container with bag holder as defined in claim 3 wherein:

a handle being mounted on said trash can body, said handle being mounted directly adjacent said rim, said handle being positioned diametrically opposite said hinge assembly.

5. The trash container with bag holder as defined in claim 1 wherein:

said blocks being formed of a rubber material.

6. The trash container with bag holder as defined in claim 1 wherein:

a lid connectable with said ring to close said access opening, said lid being disconnectable from said ring.

* * * * *